United States Patent [19]

Kousokabe

[11] 4,357,132

[45] Nov. 2, 1982

[54] HERMETIC SCROLL FLUID DISCHARGE APPARATUS WITH PRESSURIZED FLUID PASSAGE IN WRAP

[75] Inventor: Hirokatu Kousokabe, Yokohama, Japan

[73] Assignee: Hitachi, Ltd., Tokyo, Japan

[21] Appl. No.: 97,693

[22] Filed: Nov. 27, 1979

[30] Foreign Application Priority Data

Dec. 1, 1978 [JP] Japan ..... 53/164669[U]

[51] Int. Cl.[3] ..... F04C 18/02; F04C 27/00

[52] U.S. Cl. ..... 418/55; 418/57

[58] Field of Search ..... 418/55, 57, 75, 77, 418/180; 417/902

[56] References Cited

U.S. PATENT DOCUMENTS 4,192,152 3/1980 Armstrong et al. ..... 418/55

FOREIGN PATENT DOCUMENTS 2812594 10/1978 Fed. Rep. of Germany ..... 418/55

*Primary Examiner*—John J. Vrablik

*Attorney, Agent, or Firm*—Antonelli, Terry & Wands

[57] ABSTRACT

A fixed scroll and an orbiting scroll each having an end plate and a wrap perpendicular to the end plate and having a mirror-like surface at the forward end are brought into intimate contact with each other such that the mirror-like surface of the wrap and the end plate of one scroll member are brought into sliding contact with the end plate and the mirror-like surface of the wrap of the other scroll member, respectively, to define fluid pockets between the two scroll members. The orbiting scroll is driven by a motor to move in orbiting movement relative to the fixed scroll to compress the fluid in the fluid pockets by gradually reducing the volume of the fluid pockets. A portion of the fluid in the fluid pockets is introduced into a hermetic container for the apparatus through communication ducts each formed on one side of the wrap of the orbiting scroll to increase the internal pressure of the hermetic container, to thereby force the orbiting scroll against the fixed scroll by the increased internal pressure of the hermetic container to provide airtight seal to the fixed and orbiting scrolls.

3 Claims, 13 Drawing Figures

HERMETIC SCROLL FLUID DISCHARGE APPARATUS WITH PRESSURIZED FLUID PASSAGE IN WRAP

BACKGROUND OF THE INVENTION

1. Field of the Invention

This invention relates to a hermetic scroll fluid discharge apparatus.

2. Description of the Prior Art

Scrool fluid discharge apparatus are known as from U.S. Pat. Nos. 3,884,599 and 3,924,977. The principle of operation of a scroll compressor, which is one example of the scroll fluid discharge apparatus, will be described first of all by referring to FIGS. 1*a*–1*d*.

In FIGS. 1*a*–1*d*, 1*a* is a fixed scroll wrap, 1*b* the center of a fixed scroll member, 2*a* an orbiting scroll wrap, 2*b* the center of an orbiting scroll member and 3 a discharge port. 4 designates fluid pockets formed by the fixed scroll member and the orbiting scroll member maintained in intimate contact with each other in superposed relation. In FIG. 1, the fixed and orbiting scroll wraps 1*a* and 2*a* are perpendicular to end plates of the scroll members and mirror-like surfaces at the forward ends of the wraps 1*a* and 2*a* move in sliding movement on the end plates. The end plates of the fixed and orbiting scroll members are not shown in FIGS. 1*a*–1*d*.

The orbiting scroll wrap 2*a* moves in such a manner that the center 2*b* of the orbiting scroll member orbits around the center 1*b* of the fixed scroll member with a radius of orbiting of $\epsilon$, so that the fluid pockets 4 have their volume gradually reduced as shown in FIGS. 1*a*–1*d*.

The volume of the fluid pockets 4 is maximized when the fluid pockets 4 are in the condition shown in FIG. 1*d*, and the fluid that has its pressure maximized is led through the discharge port 3 to outside.

Owing to the pressure of the fluid in the fluid pockets 4, a force tending to urge the orbiting scroll member away from the fixed scroll member (hereinafter referred to as an axial biasing force) acts on the orbiting scroll member. Thus, it is necessary that the scroll compressor be provided with axial sealing means for forcing the orbiting scroll member against the fixed scroll member against the axial biasing force. Axial sealing means of the prior art will now be described.

FIG. 2 is a sectional view of a scroll compressor of the prior art. The scroll compressor shown in FIG. 2 is disclosed in Japanese Patent Application Laid-open No. 119412/78 and the corresponding application filed in the United States of America is identified as Ser. No. 887,252, now abandoned.

In FIG. 2, 1 is a fixed scroll member and 2 an orbiting scroll member. The two scroll members 1 and 2 are each provided with an end plate and have wraps 1*a* and 2*a*, respectively, arranged in vortical form on the respective end plates. 6 is a drive shaft for driving the orbiting scroll member 2, and 5 a main frame supporting the drive shaft 6 connected to motor 7. All the elements described hereinabove are contained in a hermetic container 8. 9 is a suction port for introducing fluid. 10 is an Oldham's ring for preventing the orbiting scroll member 2 from rotating on its own axis about its center (indicated at 2*b* in FIG. 1*b*). As described hereinabove, the orbiting scroll member 2 moves in such a manner that the center thereof orbits around the center of the fixed scroll member 1 and does not move about its own center axis. 11 is a lubricant in the hermetic container 8.

In the scroll compressor of the prior art constructed as aforesaid, means is provided for providing axial seal to the fixed and orbiting scroll members 1 and 2 by keeping the pressure in the hermetic container 8 at a predetermined level so that the pressure forces the orbiting scroll member 2 against the fixed scroll member 1 to attain the end. Such means comprises communication ports 2*d* for introducing a portion of the fluid under pressure in the fluid pockets 4 therethrough into the hermetic container 8 to increase the pressure therein. The communication ports 2*d* in FIG. 2 and formed in an end plate 2*c* of the orbiting scroll member 2. The pressure in the fluid pockets 4 in the compression stroke is led through the communication ports 2*d* to the hermetic container 8 to increase the pressure therein. FIGS. 3*a* and 3*b* show, on an enlarged scale, the essential portions of the compressor in the vicinity of the communication port 2*d*. The scroll compressor constructed as aforesaid has since been found to have the following disadvantages.

When the two scroll members 1, 2 are positioned as shown in FIG. 3*a*, the internal pressure in the hermetic container 8 is equal to the internal pressure in the fluid pocket 4*a* because communication is maintained through the communication port 2*d* between the fluid pocket 4*a* and the hermetic container 8. As evident from a review of FIGS. 1*a*–1*b*, the pocket 4*a* kept in communication with the hermetic container 8 through the communication port 2*d* is related in pressure to the fluid pocket 4*b*, 4*c* illustrated in FIG. 3*a* in such a manner that the pressure therein becomes higher in going toward the center of the scroll members so that the pressures in the sections or areas designated A and B in FIG. 2 are distinct from each other. In the section or area designated A, the fluid pocket 4*c* is on the center side and the compression stroke progresses in the order of 4*b*-4*a*-4*c* so that the internal pressure of the fluid pocket 4*c* is higher than the internal pressure of the fluid pocket 4*a* and the internal pressure of the fluid 4*b* is lower than that. In the section or area designated B in FIG. 2, the situation is in reverse for the fluid pocket 4*b* is on the center side and the compression stroke progresses in the order of 4*c*-4*a*-4*b* so that the internal pressure of the fluid pocket 4*b* is higher than the internal pressure of the fluid pocket 4*a* and the internal pressure of the fluid pocket 4*c* is lower than that.

When the compression stroke progresses, corresponding to section or area B in FIG. 2, and the two scroll members 1 and 2 are in the position shown in FIG. 3*b*, the communication port 2*d* should be completely closed. However, since the communication port 2*d* is formed in the end plate 2*c* of the orbiting scroll member 2, it is the mirror-like surface of the forward end of the fixed scroll wrap moving in sliding movement on the end plate 2*c* that closes the communication port 2*d*. The portion of the surface of the end plate 2*c* surrounding the communication port 2*d* is in contact with the mirror-like surface of the fixed scroll wrap in a zone corresponding to the thickness of the fixed scroll wrap 1*a* minus the diameter of the communication port 2*d*, so that, taking into account the pressure relationship between the fluid pockets 4*a*, 4*b*, 4*c*, namely, that the internal pressure of the fluid pocket 4*b* is less than the internal pressure of the pocket 4*a*, the fluid tends to leak, as indicated by an arrow A, in FIG. 3*b* in a direction toward the fluid pocket 4*b* from the hermetic container 8. As shown in FIG. 3c, corresponding to section or area B in FIG. 2, since the internal pressure of the fluid pocket 4b is higher than that in the fluid pocket 4a, in contrast to the pressure relationship in FIG. 3b, a fluid leak represented by the arrow $A_2$ is directed from a fluid pocket 4b of higher pressure to the hermetic container 8 to thereby increase the internal pressure therein. If the fluid leaks in these two situations are equal to each other in amount, they would cancel each other out and the pressure level in the hermetic container would be kept constant. However, this in not the case because the pressure differentials that influence the fluid leaks differ from each other. An increase in the internal pressure of the hermetic container 8 results in an increase in the axial biasing force urging the orbiting scroll member 2 against the fixed scroll member 1. A rise in this axial biasing force above an optimum biasing force level causes an increase in mechanical loss that may reduce heat insulating efficiency and a breakage of an oil film that may cause seizure or galling in the sliding surfaces. As shown in FIG. 8, generally, a compression stroke 1-2-3-4-5 is expressed as $PV_K=C$, where C is constant, P is the pressure, V is volume, and K is adiabatic indes of the fluid ($K>1$). The numbers 1-5 in FIG. 8 indicate the various stages of the fluid pockets of the compressor. Assuming that the communication port is formed in the position designated by the number 3 in FIG. 8, and the internal pressure of the hermetic container 8 is kept at a pressure $P_n$, a pressure differential that influences the fluid leak is such that, as shown by the arrow $A_1$ in FIG. 3b, a fluid leak occurs from the hermetic container 8 to the fluid pocket designated by the number 2 in FIG. 8 of a lower pressure so that a pressure differential in this situation would be $\Delta P_1$.

As shown by the arrow $A_2$ in FIG. 3c, a fluid leak occurs at the fluid pocket represented by the numeral 4 in FIG. 8 of a higher pressure level to the hermetic container 8 resulting in a pressure differential of $\Delta P_2$. Thus, the pressure differentials have a relationship of $\Delta P_1<\Delta P_2$ at all times. This means that, assuming other conditions affecting fluid leaks such as, for example, leak area, lubrication, etc. are equal, a fluid leak acts at all times in a manner to raise the pressure in the hermetic container 8.

SUMMARY OF THE INVENTION

This invention has as its object the provision of an improved hermetic scroll discharge apparatus that obviates the aforesaid advantages.

In order to accomplish the aforesaid object, according to the present invention, there are provided communication ducts each opening, at least in one portion thereof, on the lateral surface of one of the fixed scroll wrap and the orbiting scroll wrap and are closed by the other scroll wrap. By this arrangement, a portion of the fluid in the fluid pockets is introduced into the hermetic container through the communication ducts of novel construction to increase the internal pressure of the hermetic container, to provide seal to the fixed and orbiting scroll members by forcing the orbiting scroll member against the fixed scroll member by the increased internal pressure of the hermetic container.

DESCRIPTION OF THE PREFERRED EMBODIMENTS

Figure 1A:
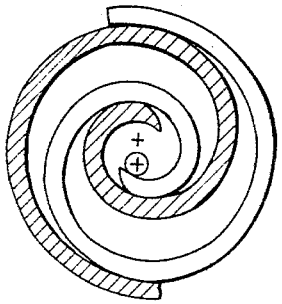
FIG. 1a PRIOR ART
FIGS. 1a–1d are views in explanation of the operation of a hermetic scroll fluid discharge apparatus of the prior art.
Figure 1B:
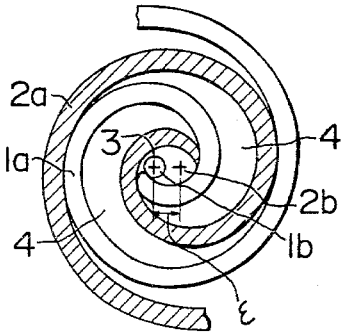
FIG. 1b PRIOR ART
Figure 1C:
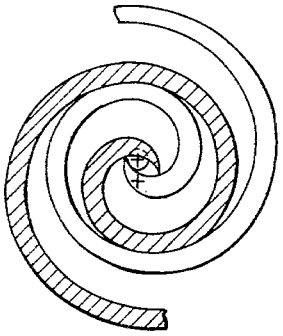
FIG. 1c PRIOR ART
Figure 1D:
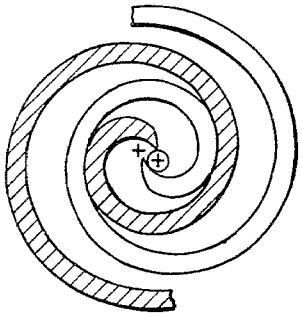
FIG. 1d PRIOR ART
Figure 2:
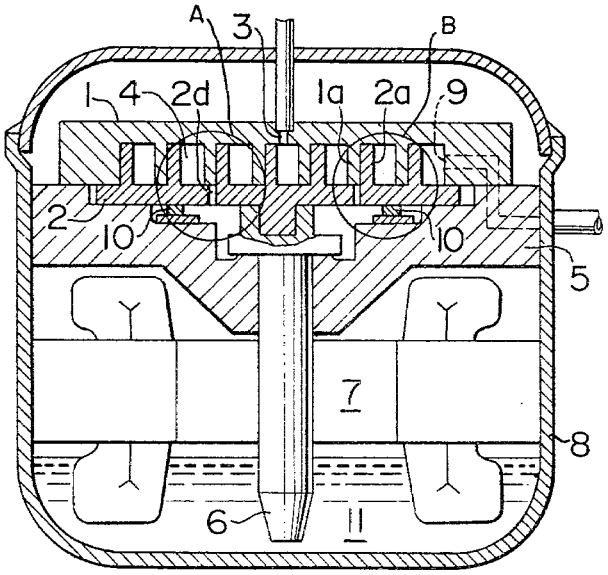
FIG. 2 PRIOR ART
FIG. 2 is a sectional view of a hermetic scroll fluid discharge apparatus of the prior art.
Figure 3A:
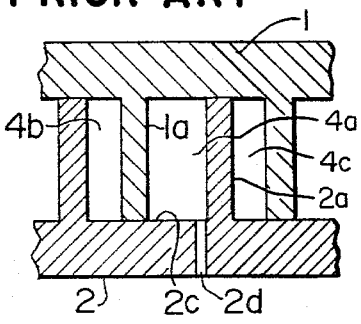
FIG. 3a PRIOR ART
FIGS. 3a, 3b and 3c are sectional views, on an enlarged scale, of the essential portions of the fixed scroll member and the orbiting scroll member of the apparatus shown in FIG. 2.
Figure 3B:
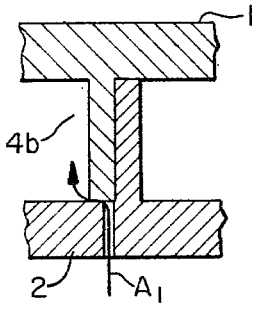
FIG. 3b PRIOR ART
Figure 3C:
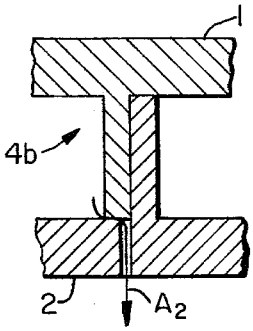
FIG. 3c PRIOR ART
Figure 8:
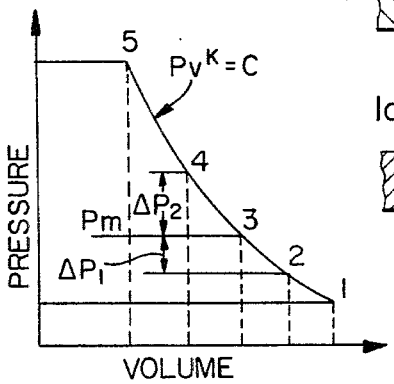
FIG. 8 is a diagramatic illustration of a pressure volume relationship of the hermetic scroll fluid discharge apparatus of the present invention functioning as a compressor.
Figure 4:
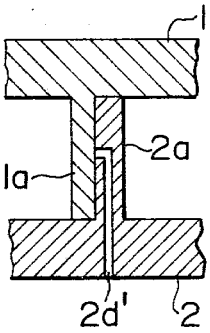
FIG. 4 is a sectional view, on an enlarged scale, of the essential portions of the fixed scroll member and the orbiting scroll member of a hermetic scroll fluid discharge apparatus comprising one embodiment of the invention.
Figure 6:
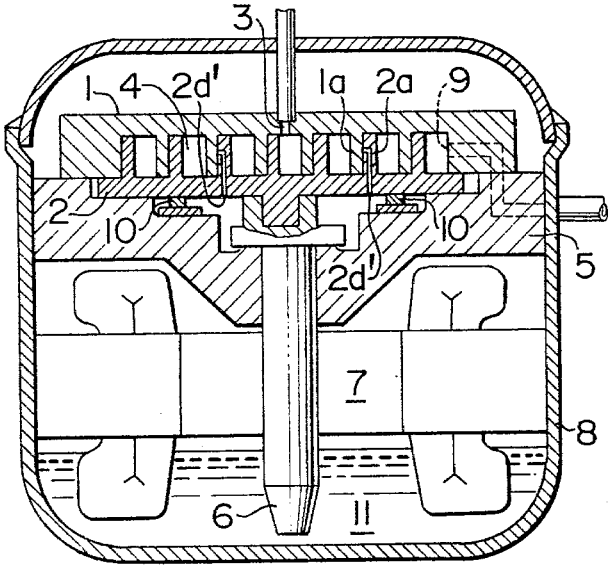
FIG. 6 is a sectional view of the hermetic scroll fluid discharge apparatus in its entirety which is shown in part in FIG. 4.

Embodiments of the invention will now be described. FIG. 4 shows in a sectional view the essential portions of the fixed scroll member and the orbiting scroll member in relation to the fluid pockets according to one embodiment of the invention, and FIG. 6 shows the embodiment in its entirety in a sectional view. In FIG. 4, a communication duct 2d' extending through the orbiting scroll member end plate and the orbiting scroll wrap 2a opens at one end on one side of the wrap 2a and at the other end on the underside of the end plate. The communication ducts 2d' are utilized for permitting a portion of the fluid in the fluid pockets 4 to flow therethrough into the hermetic container 8 to increase the internal pressure of the latter.

As can be seen in FIG. 4, the one end of the communication duct 2d' is closed by one side of the fixed scroll wrap 1a so that the end of the communication duct 2d' is covered by a portion of the wrap of a greater area than the portion of the wrap hitherto used for sealing the communicating port of the prior art, thereby ensuring complete blocking of the communication duct 2d'. Since the blocking of the communication duct 2d' is effected by one side of the fixed scroll wrap according to the invention, no influences are exerted on the blocking of the communication duct 2d' by the axial seal provided to the fixed and orbiting scroll members. In the prior art, the communication ports open on the end plate of the orbiting scroll member which is in sliding contact with the mirror-like surface of the forward end of the fixed scroll wrap so that there are possibilities of the airtight seal provided to the fluid pockets being destroyed by wear of the scroll wrap and scroll member end plate in the vicinity of the communication ports.

According to the invention, the communication ducts open on one side of the wrap which is least affected by the sliding movement of the orbiting scroll wrap on the fixed scroll member end plate. The communication ducts according to the invention would be considered superior to the communication ports of the prior art when the influences exerted by wear of the scroll member are taken into consideration.

Even if complete blocking of the communication ducts 2d' by one side of the fixed scroll wrap 1a is not achieved, the differential pressure caused by leak of fluid would be very small because the end of the communication duct 2d is covered over a large area, so that the leak can be minimized.

Figure 5:
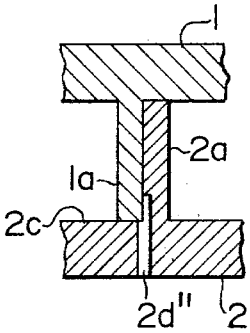
FIG. 5 is a sectional view, on an enlarged scale, of the essential portions of the fixed scroll member and the orbiting scroll member of a hermetic scroll fluid discharge apparatus comprising another embodiment of the invention.

FIG. 5 shows another embodiment in which the communication ducts 2d'' open at one end both on one side of the wrap 2a and on the end plate 2c of the orbiting scroll member. The communication ducts 2d'' of this embodiment can be formed by drilling carried out from one direction only. Thus, the embodiment shown in FIG. 5 has higher workability than the embodiment shown in FIG. 4. Also, the embodiment shown in FIG. 5 can be covered by a larger area of the wrap and end plate of the scroll than the embodiment shown in FIG. 4.

Figure 7:
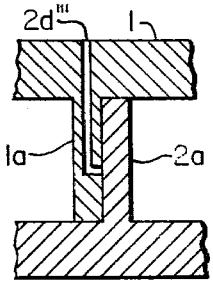
FIG. 7 is a sectional view, on an enlarged scale, of essential portions of the fixed scroll member and orbiting scroll member of a hermetic scroll fluid discharge apparatus constructed in accordance with another embodiment of the present invention.

In the embodiments shown and described hereinabove, the communication ducts 2d', 2d'' open one side of the orbiting scroll wrap and closed by one side of the fixed scroll wrap. However, as shown in FIG. 7, the invention is not limited to this arrangement and for the communication ducts 2d''' may open on one side of the fixed scroll wrap 1a and closed by one side of the orbiting scroll wrap 2a.

The scroll fluid discharge apparatus incorporating the present invention therein may function not only as a compressor but also as an expander.

From the foregoing description, it will be appreciated that according to the invention communication ducts are provided to open on one side of one of the fixed and orbiting scroll wraps to permit pressurized fluid to pass therethrough from the fluid pockets to the hermetic container, to maintain axial seal of the hermetic scroll fluid discharge apparatus. The invention enables control of the internal pressure of the hermetic container to be effected by a simple mechanism, thereby permitting the hermetic scroll fluid discharge apparatus to operate with high efficiency and reliability both when the apparatus is started and during steady operation.

What is claimed is:

1. A hermetic scroll fluid discharge apparatus comprising:

a. a fixed scroll member including an end plate and a wrap means arranged in vortical form, said wrap means extending perpendicularly to said end plate to have a predetermined height and provided with a mirror-like surface at the forward end thereof;

b. an orbiting scroll member including an end plate and a wrap means arranged in vortical form reversed in pattern from the vortical form of said wrap means of said fixed scroll member, said fixed scroll member and said orbiting scroll member being in engagement with each other in such a manner that the mirror-like surface of the wrap means of the fixed scroll member is in sliding contact with the end plate of the orbiting scroll member and the mirror-like surface of the wrap means of the orbiting scroll member is in sliding contact with the end plate of the fixed scroll member, to define fluid pockets between the end plates and wrap means of the fixed and orbiting scroll members;

c. a hermetic container containing at least said two scroll members in airtight relation;

d. means for supplying fluid from outside the hermetic container to the fluid pockets;

e. means for discharging fluid from said fluid pockets to the outside of said hermetic container; and f. means for driving said orbiting scroll member to move in orbiting movement; wherein the improvement comprises communication means opening at one end in said fluid pockets and at the other end in said hermetic container, said one end of said communication means being formed at least in one portion thereof in the wrap means of one of the fixed scroll member and the orbiting scroll member to permit pressurized fluid to be introduced from the fluid pockets to the hermetic container.

2. A hermetic scroll fluid discharge apparatus as claimed in claim 1, wherein said one end of said communication means is formed on one side of the wrap means of the orbiting scroll member, and wherein a fluid passage communicating said one end with said the other end opening in the hermetic container is formed in the end plate of the orbiting scroll member, so that said one end, said the other end and said fluid passage constitute said communication means.

3. A hermetic scroll fluid discharge apparatus as claimed in claim 1, wherein said one end of said communication means is formed on one side of the wrap means of the fixed scroll member, and wherein a fluid passage communicating said one end with said the other end opening in the hermetic container is formed in the end plate of the fixed scroll member, so that said one end, said the other end and said fluid passage constitute said communication means.

* * * * *